US008632275B2

(12) United States Patent
Chagnot et al.

(10) Patent No.: US 8,632,275 B2
(45) Date of Patent: Jan. 21, 2014

(54) EXCAVATION MACHINE WITH A PIVOTABLE KELLY BAR

(75) Inventors: Philippe Chagnot, Rueil Malmaison (FR); Laurent Pivert, Rueil Malmaison (FR)

(73) Assignee: Soletanche Freyssinet, Rueil Malmaison (FR)

( * ) Notice: Subject to any disclaimer, the term of this patent is extended or adjusted under 35 U.S.C. 154(b) by 173 days.

(21) Appl. No.: 12/648,807

(22) Filed: Dec. 29, 2009

(65) Prior Publication Data

US 2010/0166534 A1 Jul. 1, 2010

(30) Foreign Application Priority Data

Dec. 30, 2008 (FR) ..... 08 59115

(51) Int. Cl.
*E21B 19/00* (2006.01)

(52) U.S. Cl.
USPC ..... 405/232; 175/162; 173/39

(58) Field of Classification Search
USPC ..... 405/232, 233, 266, 267, 269; 175/162; 173/39
See application file for complete search history.

(56) References Cited

U.S. PATENT DOCUMENTS

| | | | | |
|---|---|---|---|---|
| 3,303,656 | A * | 2/1967 | Landau | 405/50 |
| 2006/0037218 | A1 * | 2/2006 | Stoetzer | 37/352 |
| 2008/0044236 | A1 | 2/2008 | Lloyd et al. | |

FOREIGN PATENT DOCUMENTS

| | | | |
|---|---|---|---|
| FR | 2 888 859 | A | 1/2007 |
| JP | 2261189 | A | 10/1990 |
| JP | 07-082743 | A | 3/1995 |
| JP | 10317868 | A | 12/1998 |
| JP | 2003-013449 | A | 1/2003 |

* cited by examiner

*Primary Examiner* — Benjamin Fiorello
(74) *Attorney, Agent, or Firm* — Kenyon & Kenyon LLP

(57) ABSTRACT

An excavation machine including —a mast having a longitudinal direction, —a bar presenting a first end provided with an excavation tool, and —a carriage movable along the longitudinal direction of the mast and including a first holder member for holding the bar relative to the carriage, the carriage being suitable for moving the bar along the longitudinal direction of the mast. The first holder member is pivotable relative to the carriage and by the fact that the first holder member presents a locked state in which the bar is prevented from moving in translation relative to the carriage, and an unlocked state in which the bar is free to move in translation relative to the carriage.

15 Claims, 6 Drawing Sheets

16
32
28
40
30
36
14a
46
34
38
A
36
26
44
48
42
18

14b
14
10
56
16
II
42
12
18
14a
20a
20
20b
22
18a
24
18b

FIG.4
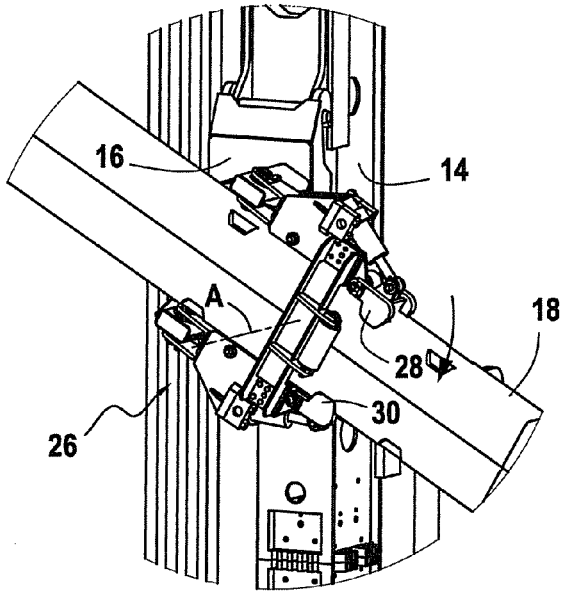
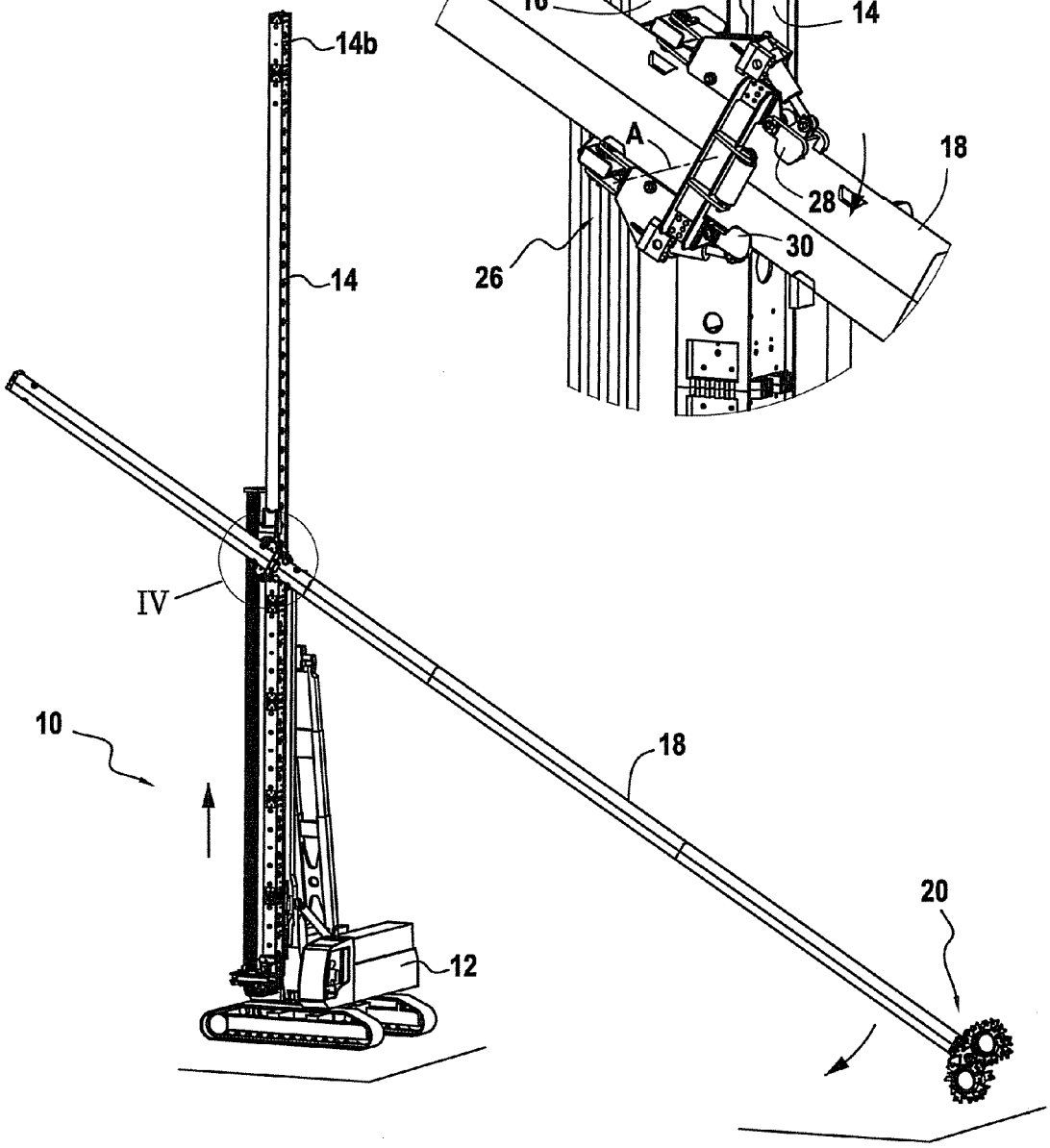
FIG.3

EXCAVATION MACHINE WITH A PIVOTABLE KELLY BAR

FIELD OF THE INVENTION

The present invention relates to the field of excavating the ground, and in particular to the technology consisting in in situ mixing of the excavated soil with a binder. The present invention thus does not relate to the field of machines for driving piles, of the type shown in JP 2003-013449.

More particularly, the present invention relates to an excavation machine comprising:

- a mast having a longitudinal direction;
- a bar presenting a first end provided with an excavation tool; and
- a carriage movable along the longitudinal direction of the mast and including a first holder member for holding the bar relative to the carriage, said carriage being suitable for moving the bar along the longitudinal direction of the mast.

BACKGROUND OF THE INVENTION

A particular example of such a machine is already known, and is described in particular in FIG. 1 of FR 2 888 859.

That machine serves in particular to implement the "soil-mixing" technique, which consists in making successive panels by mixing the cut soil with a cement in situ in the trench, or more generally mixing it with a binder, the soil/binder mixture subsequently forming the wall. That technique is in particularly widespread use for making retaining walls or sealing screens.

That machine may also be used for making walls that are buried in the ground, of the diaphragm wall type. That consists in forming successive trench portions in the ground with the help of such an excavation machine, and in filling the trench as made in that way with cement or concrete.

In order to make trench portions, the carriage slides along the mast from its top end down to its bottom end. In other words, the stroke of the carriage corresponds substantially to the length, or height, of the mast. Insofar as the bar, usually referred to as a "kelly" bar by the person skilled in the art, is held by the carriage, it can be understood that the stroke of the kelly bar is likewise substantially equal to the height of the mast. It therefore follows that the machine is suitable for making trench portions of a depth that can be no greater than the height of the mast.

In other words, the excavation depth of the machine is limited by the height of the mast. That presents a drawback, since in practice, the length of excavation machine masts is limited to about 20 meters (m) even though it is sometimes desirable to be able to reach excavation depths that are considerably deeper.

It is known that one solution to that problem is to use a bar or kelly bar of length that is longer than the length of the mast.

That apparently simple solution is difficult to implement since, at present, it is difficult to raise the bar so as to mount it on the mast, with the mast being in the vertical position and the bar possibly being as much as thirty meters long.

More generally, there is the problem of mounting the bar on the mast, regardless of the length of the bar. At present, it is necessary to make use of external hoist means for mounting the bar on the mast. Furthermore, connecting hydraulic hoses for powering the motors of the excavation tool is difficult and dangerous to undertake since operators need to take action high above the ground.

OBJECT AND SUMMARY OF THE INVENTION

An object of the invention is to provide an excavation machine that enables the bar to be raised easily, particularly but not exclusively, when the bar is longer than the mast.

The invention achieves this object by the fact that the first holder member is pivotable relative to the carriage and the first holder member presents a locked state in which the bar is prevented from moving in translation relative to the carriage, and an unlocked state in which the bar is free to move in translation relative to the carriage, and by the fact that the mast presents a first end that carries a second holder member suitable for receiving and holding the bar relative to the mast, said second holder member presenting a locked state in which the bar is prevented from moving relative to the mast, and an unlocked state in which the bar is free to move relative to the mast.

By means of the invention, it can be understood that the bar can be raised as follows: starting from a position in which the bar is placed on the ground in a substantially horizontal position, i.e. substantially perpendicular to the mast, the bar remote from the first end is engaged in the first holder member, and then the first holder member is locked prior to moving the carriage, secured to the bar, up towards the top end of the mast.

Since the first holder member is mounted to pivot relative to the carriage, it can be understood that raising the bar is accompanied by the bar taking up a progressively more vertical position by pivoting. Preferably, the bar pivots naturally relative to the carriage as the carriage moves, as a result of gravity acting on said bar.

Without going beyond the ambit of the present invention, the excavation machine enables other methods to be implemented for raising the bar, some of which are defined below, specifically when the bar is longer than the mast.

Preferably, the first holder member is suitable for pivoting about a pivot axis that is orthogonal to the longitudinal direction of the mast, such that, while the bar is being raised, it pivots in a plane that is substantially vertical.

In a preferred embodiment, the pivot axis is orthogonal to an excavation plane. The excavation plane is defined as being the substantially vertical plane in which the portion of the trench excavated by the excavation tool extends.

Advantageously, the bar is suitable for sliding in the second holder member when it is in its unlocked position.

It can thus be understood that the bar can be raised by moving the machine towards the first end of the bar, while said first end is held on the ground, so that the bar takes up a progressively more vertical position by sliding through the first holder member, said member pivoting naturally during the movement of the carriage towards the top end of the mast.

Furthermore, it can be understood that the second holder member advantageously enables the bar to be prevented from moving relative to the mast when the first holder member is unlocked, e.g. while it is being moved along the mast.

In practice, the second holder member is used after the bar has been taken to its vertical position, i.e. the bar is engaged in the second holder member while it is itself in a vertical position.

Preferably, in like manner to the first holder member, the bar is suitable for sliding in the second holder member when the second holder member is in the unlocked position.

As a result, the first and second holder members also constitute means for guiding the bar in vertical translation.

Advantageously, the excavation tool includes at least one hydraulic motor and the machine further includes at least one first hydraulic pipe connecting the carriage and the hydraulic motor via a second end of the bar opposite from the first end, while passing via the inside of the bar, and at least one second hydraulic pipe connecting the carriage and a hydraulic coupling located substantially halfway along the mast, said coupling being designed to be connected to a hydraulic power source for powering the hydraulic motor.

It can be understood that the first and second hydraulic pipes enable the hydraulic motor to be powered hydraulically: the power source delivers hydraulic power to the motor by passing successively via the hydraulic coupling, the second hydraulic pipe, and the first hydraulic pipe.

A hydraulic return circuit, known in itself, is preferably also provided.

Consequently, the second hydraulic pipe needs to be long enough to allow the carriage to remain connected to the hydraulic connection regardless of the position of the carriage along the mast.

In addition, the first hydraulic pipe needs to be long enough for the carriage to remain connected to the second end of the bar while the bar is being raised, and naturally when the bar has reached its vertical position.

The fact that the coupling is disposed halfway along the mast serves to minimize the length of the second hydraulic pipe.

According to a particularly advantageous aspect of the invention, the hydraulic pipe may be connected while the bar is in its lowered position substantially perpendicular to the mast. In this position, the hydraulic pipes are much easier to assemble than in the prior art where it was necessary for operators to take action at a height.

Preferably, the excavation tool is a soil-mixing cutter. In other words, the excavation tool serves both to excavate the soil and to mix it with a binder that may be delivered to the trench via a tube that extends inside the bar.

The excavation machine of the invention is thus preferably a machine of the "soil-mixing" type.

The present invention also provides a first method of method of raising a bar of an excavation machine of the invention, said bar presenting a length that is substantially longer than the length of the mast, in which method, starting from a position in which the bar is substantially perpendicular to the mast, with the excavation tool resting on the ground, the bar is moved into a position substantially parallel with the mast by moving the excavation machine towards the excavation tool, the excavation tool remaining stationary, while the first holder member is in the unlocked state.

The first method of the invention also includes a step during which the first end of the bar is engaged in the second holder member after the carriage has reached the second end of the mast.

As the machine comes closer to the excavation tool, the bar progressively takes up a more vertical position by pivoting away from its horizontal position. Simultaneously, the carriage moves naturally or under mechanical drive towards the second end of the mast. In this method, it can be understood that the bar takes up a vertical position while sliding through the first holder member.

The present invention also provides a second method of raising a bar of an excavation machine of the invention, said bar presenting a length that is substantially longer than the length of the mast, in which method, starting from a position in which the bar is practically perpendicular to the mast, the bar is brought into a position substantially parallel to the mast by moving the carriage from a first end of the mast towards a second end of the mast opposite from the first end, the bar being prevented from moving relative to the first holder member.

During the second raising method, the bar is prevented from moving relative to the first holder member. The carriage is must therefore be secured to the bar at a distance from the first end of the bar that is no greater than the height of the mast.

In order to prevent the bar from moving relative to the first holder member, it is ensured that the first holder member is in the locked state while the carriage is moved.

Advantageously, the above-defined method further includes a step during which the first end of the bar is engaged in the second holder member after the carriage has reached the second end of the mast.

It can thus be understood that, at the end of the above-described raising method, the bar is ready to be held, moved, and guided in translation along the mast by means of the first and second holder members.

Finally, the invention provides an excavation method in which an excavation machine of the invention is provided, said machine including a bar that is substantially longer than the mast, said method comprising the following successive steps:

- a raising step during which the bar is brought into a position substantially parallel with the mast;
- a positioning step in which the carriage is positioned at the second end of the mast;
- a first sinking step of sinking the excavation tool into the ground, during which the first holder member is locked if it is not already locked, and the carriage while locked to the bar is moved towards the first end of the mast so as to bring the excavation tool into a first sunk position;
- a positioning step in which the carriage is positioned at the second end of the mast, after the first holder member has been put into the unlocked state, the excavation tool remaining in its first sunk position; and
- a second sinking step of sinking the excavation tool, this step being analogous to the first sinking step, so as to bring the excavation tool into a second sunk position.

According to the invention, the mast presents a first end that carries a second holder member suitable for receiving and holding the bar relative to the mast, said second holder member presenting a locked state in which the bar is prevented from moving relative to the mast, and an unlocked state in which the bar is free to move relative to the mast. According to the invention, the first end of the bar is engaged in the second holder member at the end of the raising step, while during the first sinking step, the second holder member is in the unlocked state, and, at the end of the first sinking step, a locking step is performed of locking the second holder member so as to prevent the bar from moving relative to the mast.

As a result, at the end of the raising step, the bar is well held by the mast, using the first and second holder members.

Thus, by means of the invention, the excavation tool is brought into its maximally-sunk position, i.e. the second sunk position, in two stages. The excavation tool is initially taken to its first sunk position prior to being taken to its second sunk position corresponding to it being sunk to its maximum depth. By means of this advantageous method, the total depth to which the excavation tool can be sunk is no longer limited to the length of the mast.

Without going beyond the ambit of the present invention, it is also possible to sink the excavation tool in some number of sinking stages greater than two, in particular when the length of the bar is much longer than that of the mast.

Preferably, the method also includes a step of raising the excavation tool, which step is performed after the second sinking step, so as to extract the excavation tool from the trench it has just excavated. This raising step is advantageously performed in at least two stages.

BRIEF DESCRIPTION OF THE DRAWINGS

The invention can be better understood and its advantages appear better on reading the following detailed description of embodiments given as non-limiting examples. The description refers to the accompanying drawings, in which:

FIG. 3 shows the FIG. 1 excavation machine while the carriage is moving towards the second end of the mast, the carriage being shown halfway along the mast;

FIG. 4 is a detail view of FIG. 3 showing the first holder member;

MORE DETAILED DESCRIPTION

Figures 1, 2:
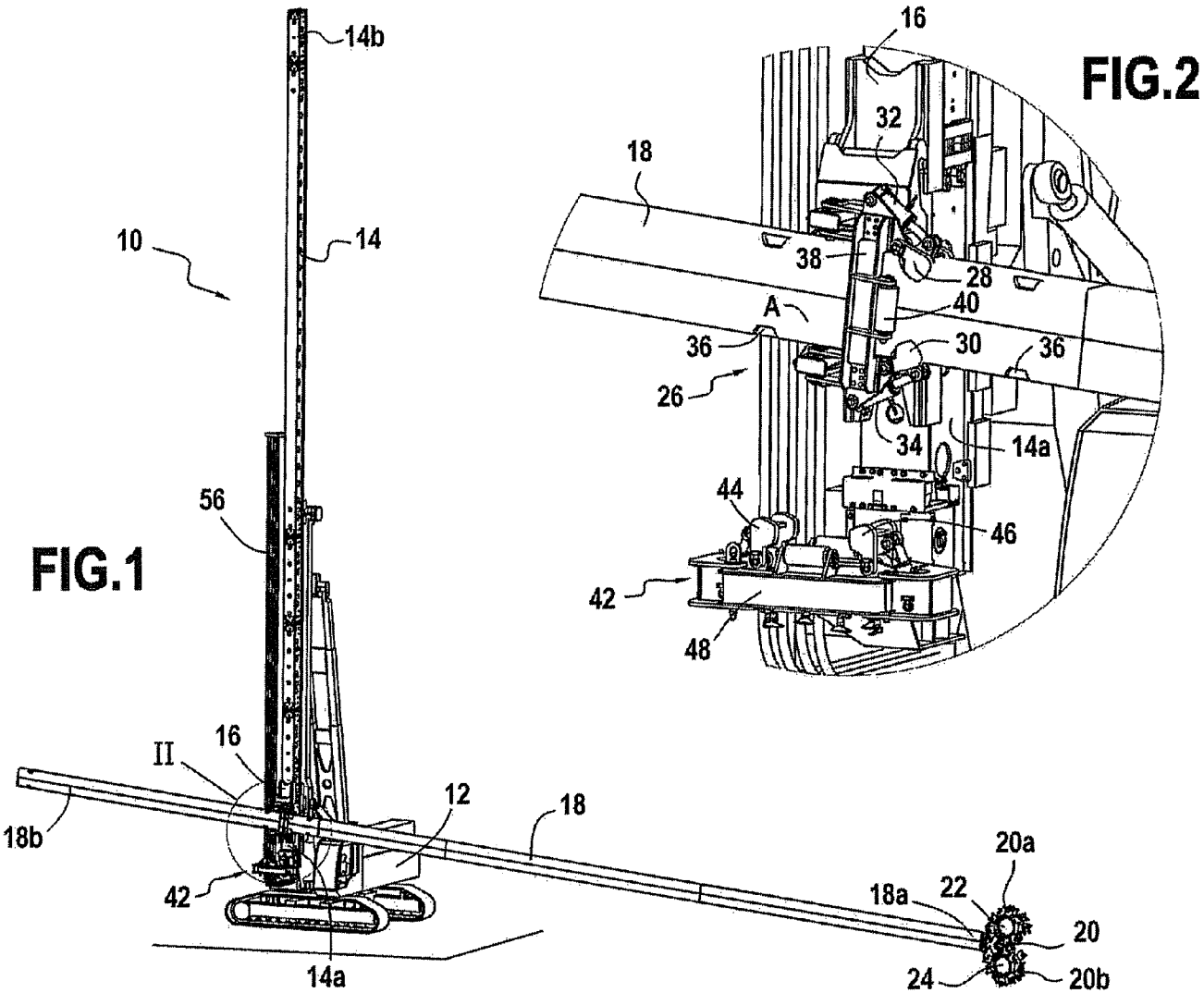
FIG. 1 shows an excavation machine of the invention, the bar being in its lowered position, substantially orthogonal to the mast.
FIG. 2 is a detail view of FIG. 1, showing the first and second holder members.

The excavation machine 10 shown in FIG. 1 comprises a movable chassis 12 having a mast 14 mounted thereon presenting a longitudinal direction, which direction is specifically vertical. The excavation machine 10 also includes a carriage 16 that is movable along the longitudinal direction of the mast, being capable of being moved, specifically vertically, between a first end 14*a* of the mast, i.e. its bottom end, and a second end 14*b* of the mast, i.e. its top end.

In known manner, the carriage 16 is designed to move a bar 18 vertically, which bar has a first end 18*a* provided with an excavation tool 20. Since the means used for moving the carriage 16 along the mast are well known to the person skilled in the art, they are not described herein.

The bar 18 is commonly referred to as a "kelly" bar by the person skilled in the art, such that in the description below, the term "bar" and "kelly bar" are both used to designate this element.

The excavation tool 20 in this example is constituted by a soil-mixing cutter of well-known type. More precisely, the excavation tool comprises two rotary tools 20*a* and 20*b* designed to turn about parallel horizontal axes during excavation operations. These rotary tools 20*a*, 20*b* are actuated by hydraulic motors 22, 24 and they serve both to cut the soil in order to make a substantially vertical trench portion corresponding to the wall that is to be made, and to mix the cut soil with the binder or the cement.

Figure 5:
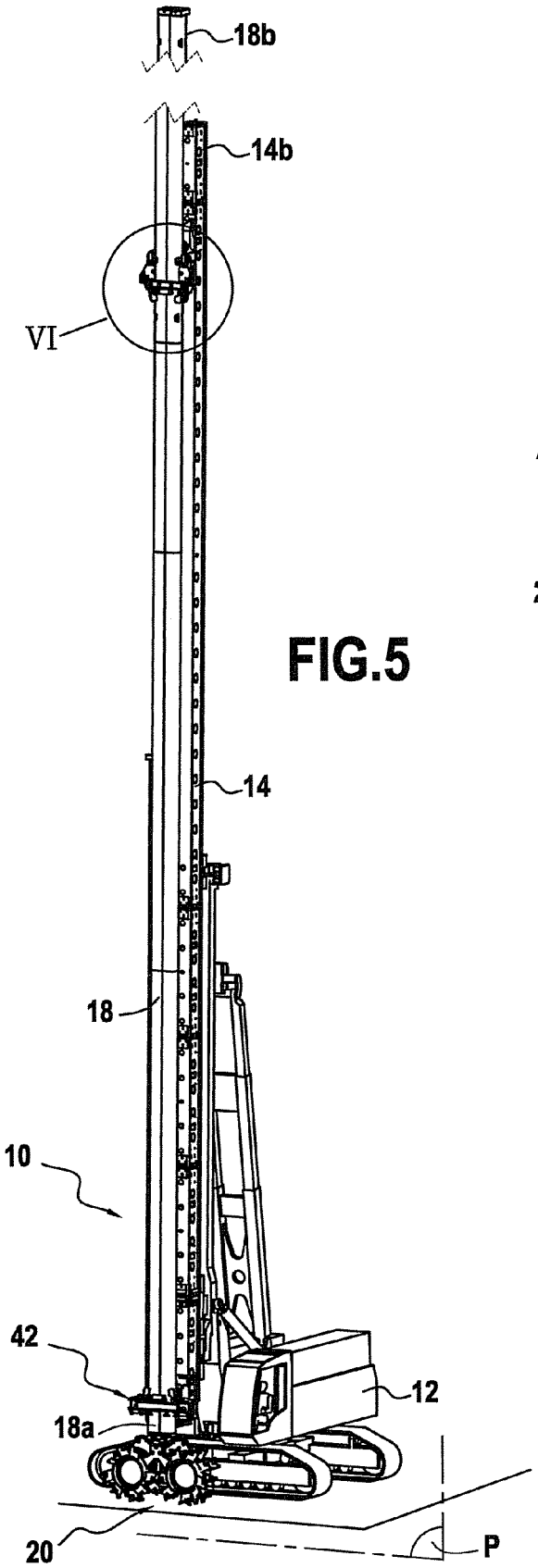
FIG. 5 shows the excavation machine of FIG. 1 when the bar is in the raised position, parallel to the mast, the carriage being positioned at the second end of the mast.

While the excavation machine 10 is in operation, the kelly bar 18 extends vertically, substantially parallel to the mast 14, as shown in FIG. 5.

As mentioned above, the carriage 16 is suitable for moving the kelly bar along the longitudinal direction of the mast 14. For this purpose, the carriage 16 includes a first holder member 26 for holding the kelly bar 18 relative to the carriage 16. In other words, the first holder member 26 enables the kelly bar 18 to be secured to the carriage 16, which carriage can then exert vertical downward thrust on the kelly bar 18 in order to push the excavation tool 20 into the soil for the purpose of making the trench portion.

The description below relates in greater detail to the operation of raising the kelly bar 18, which operation consists in taking the kelly bar from a substantially horizontal lowered position in which the kelly bar is substantially orthogonal to the mast 14 (FIG. 1) to a raised position in which the kelly bar is parallel to the mast (FIG. 5).

In the example described herein, it should also be specified that the kelly bar 18 is longer than the mast 14, specifically the kelly bar 18 is about 30% longer than the mast 14.

In accordance with the invention, the first holder member 26 is capable of pivoting relative to the carriage 16. In the example described herein, the first holder member 26 is free to pivot relative to the carriage 16.

Figure 6:
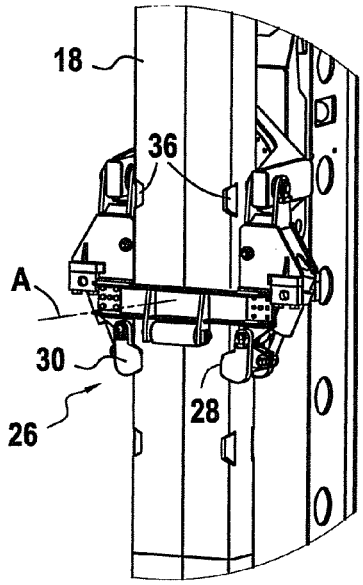
FIG. 6 is a detail view of FIG. 5, showing the first holder member.

More precisely, the first holder member is suitable for pivoting about a pivot axis A that is orthogonal to the longitudinal direction of the mast 14. This axis A, more clearly visible in FIGS. 2, 4, and 6, is also orthogonal to an excavation plane P corresponding to the vertical plane in which the trench portion being excavated by the excavation tool 20 extends.

Figure 7:
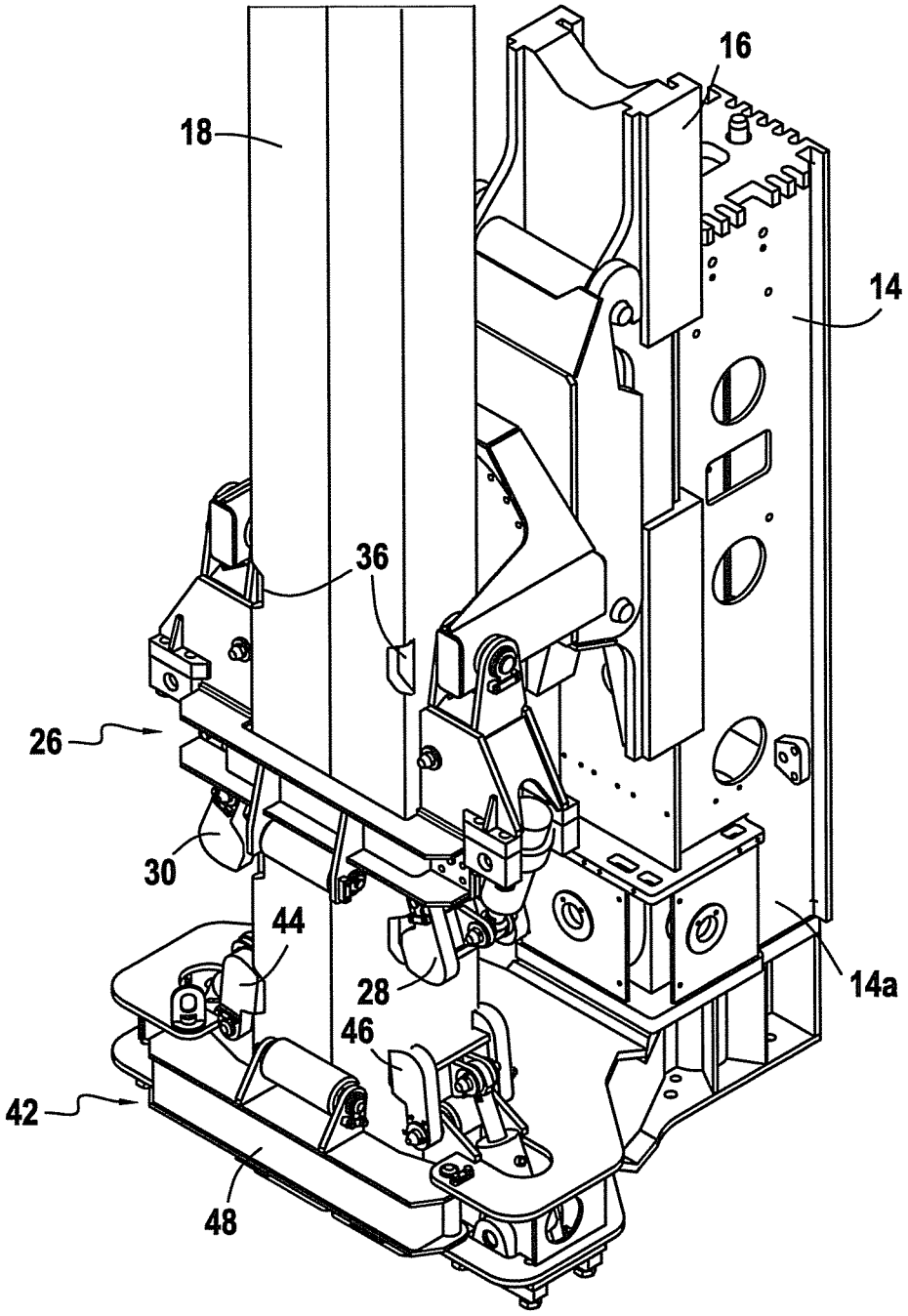
FIG. 7 is a detail view of the first end of the mast, showing the first holder member in the unlocked position and the second holder member in the locked position, the carriage being positioned at said first end of the mast.

Furthermore, in advantageous manner, the first holder member 26 presents a locked state, as shown in FIG. 2, in which the bar 18 is prevented from moving in translation relative to the carriage 16, and an unlocked state in which the bar 18 is free to move in translation relative to the carriage 16, as shown in FIG. 7. Specifically, the kelly bar 18 is suitable for sliding in the first holder member when it is in its unlocked position. It can thus be understood that in the unlocked state, the carriage 16 is also free to move in the longitudinal direction of the bar 18.

In order to prevent the kelly bar 18 from moving in translation relative to the carriage 16, the first holder member has fingers 28, 30 that are suitable for being actuated by actuators 32, 34. These fingers 28, 30 are mounted to pivot so as to be housed transversely in orifices 36 that are formed along the longitudinal edges of the kelly bar 18. It can thus be understood that in the locked state, the fingers 28, 30 are inserted in the orifices 36, thereby preventing the kelly bar 18 from moving in translation, whereas in the unlocked state, the fingers 28, 30 are retracted out from the orifices so that they do not oppose movement of the kelly bar 18 in translation relative to the carriage 16.

In addition, the first holder member 26 includes a holder bridge 38 provided with at least one roller 40 that extends transversely across the longitudinal direction of the bar, so as to prevent the kelly bar 18 from disengaging from the first holder member 26. In a variant, the roller 40 could be replaced by a wear plate.

According to another advantageous aspect of the invention, the first end 14*a* of the mast 14 carries a second holder member 42, visible in FIGS. 2 and 7, that is suitable for receiving and holding the kelly bar 18 relative to the mast 14 after the kelly bar 18 has been moved into the vertical position.

The second holder member 42 is secured to the mast and does not turn, unlike the first holder member 26.

Furthermore, like the first holder member 26, the second holder member 42 presents a locked state (FIG. 7) in which the bar 18 is prevented from moving relative to the mast 14, and an unlocked state in which the bar 18 is free to move relative to the mast 14. More precisely, when the second holder member is in the unlocked state, the bar 18 is free to slide vertically therethrough.

The second holder member 42 also includes fingers 44, 46 for co-operating with the above-mentioned orifices 36 so as to enable the kelly bar 18 to be prevented from moving relative to the mast 14.

In addition, the second holder member 42 includes a removable bridge 48 enabling the second holder member to be opened in order to house the bar 18 therein.

That stated, there follows a description in greater detail of a method of raising the bar 18 of the excavation machine of the invention, the description being given with reference to FIGS. 1 to 6.

As mentioned above, the bar 18 is longer than the mast 14.

To begin, as shown in FIG. 1, the starting position is generally one in which the bar 18 is practically perpendicular to the mast 14, with the excavation tool 20 resting on the ground.

As can be seen in FIGS. 1 and 2, the bar 18 is initially engaged in the first holder member 26 so that the distance between the carriage 16 and the excavation tool 20 is no greater than the height of the mast 14, the first holder member 26 then being unlocked.

Thereafter, the bar 18 is prevented from moving relative to the first holder member 26, preferably by locking the first holder member 26.

The carriage 16 is then moved towards the second end 14*b* (the top end) of the mast 14, as shown in FIG. 3.

The action of gravity on the portion of the bar 18 that extends between the first holder member 26 and the excavation tool 20 tends to cause the bar 18 to pivot about the pivot axis A while the carriage 16 is moving, and to pivot in such a direction that the excavation tool moves towards the first end 14*a* of the mast 14. In FIG. 4, showing the first holder member 26 in detail, it can be seen that the kelly bar 18 has pivoted clockwise.

Finally, when the carriage 16 is at the top end 14*b* of the mast 14, the kelly bar 18 is then suspended vertically from the first holder member 26, as shown in FIG. 5. In other words, the kelly bar 18 is in its raised position.

In order to improve holding of the kelly bar 18 relative to the mast 14, the first end 18*a* of the kelly bar 18 is engaged in the second holder member 42, by opening the removable bridge 48.

Under such circumstances, the kelly bar 18 can be held by the second holder member 42, as shown in the fragmentary view of FIG. 7.

Figure 8:
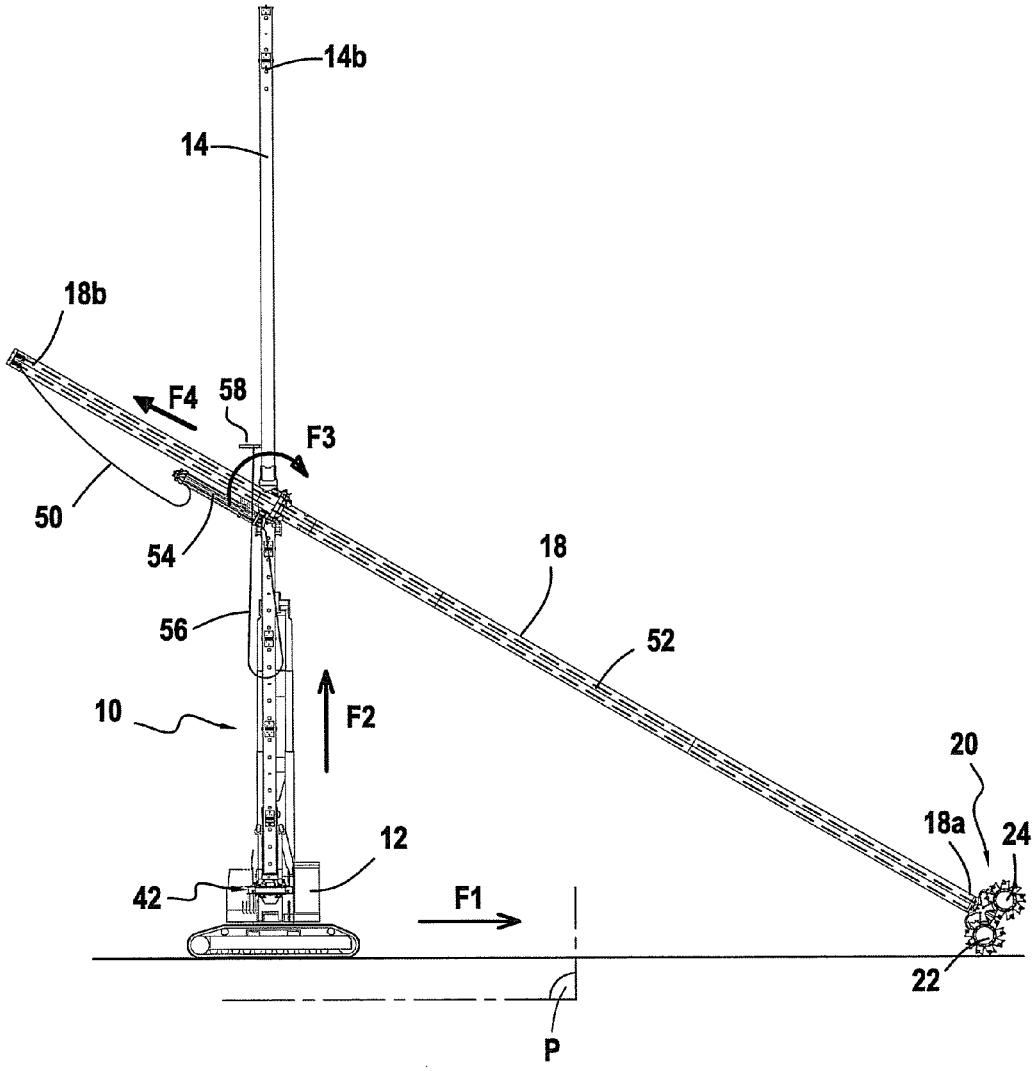
FIG. 8 is a detail view of the first end of the mast, showing the first and second holder members.

With reference to FIG. 8, there follows a description of another method of raising the bar 18 in accordance with the invention.

In this method, the starting position is likewise a position in which the kelly bar 18 is practically perpendicular to the mast 14, i.e. substantially horizontal, with the excavation tool 20 resting on the ground, but while resting stationary.

In the invention, the kelly bar 18 is brought into a position that is substantially parallel to the mast 14 by moving the machine 10 towards the excavation tool in the direction of arrow F1, while simultaneously the first holder member 26 is in the unlocked state so as to enable the kelly bar 18 to slide through the first holder member 26.

The movement of the excavation machine 10 towards the cutter tool 20, while the tool remains stationary, encourages the carriage 16 to move up towards the top end 14*b* of the mast 14 (arrow F2) and causes the kelly bar 18 to pivot about the pivot axis A, specifically clockwise (arrow F3), and causes the kelly bar 18 to slide through the first holder member 26 (arrow F4).

It can thus be understood that when the excavation machine comes up to the excavation tool, the kelly bar 18 is in its vertical position.

In this method, there is no need to engage the kelly bar 18 in the first holder member 26 in such a manner that the length between the carriage 16 and the cutter member is no greater than the height of the mast. If the carriage 16 reaches the second end 14*b* of the mast before the kelly bar 18 is vertical, then it will continue to pivot about the pivot axis A while sliding through the first holder member until the machine comes up to the position of the excavation tool 20.

In another advantageous variant, the two above-described methods are combined, i.e. the carriage is raised towards the top end of the mast while simultaneously moving the machine towards the cutter tool.

With reference to FIGS. 9 to 12, there follows a description of an excavation method of the present invention.

These figures are diagrammatic side views of the excavation machine 10 during the excavation operation.

Figure 9:
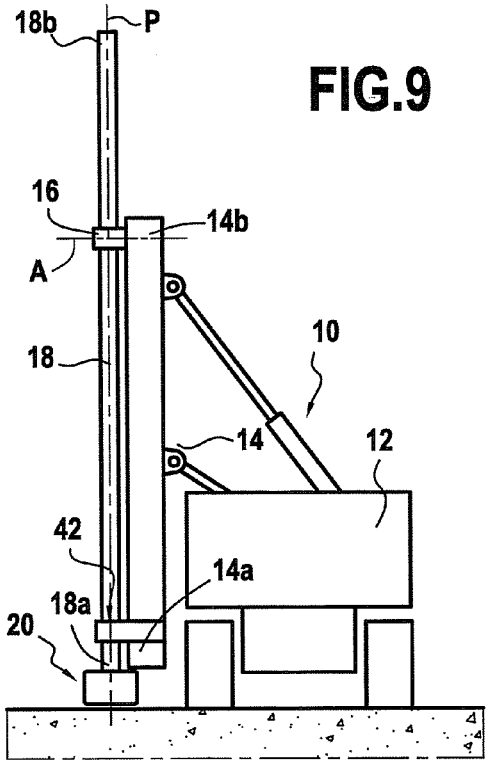
FIGS. 9 to 12 show the excavation method of the invention.

After the kelly bar 18 has been raised into the vertical position, in particular using one or other of the above-described methods, the carriage 16 is positioned at the top end 14*b* of the mast 14, as shown in FIG. 9. Thereafter, the first end 18*a* of the kelly bar 18 is engaged in the second holder member 42 by opening the bridge 48.

Figure 10:
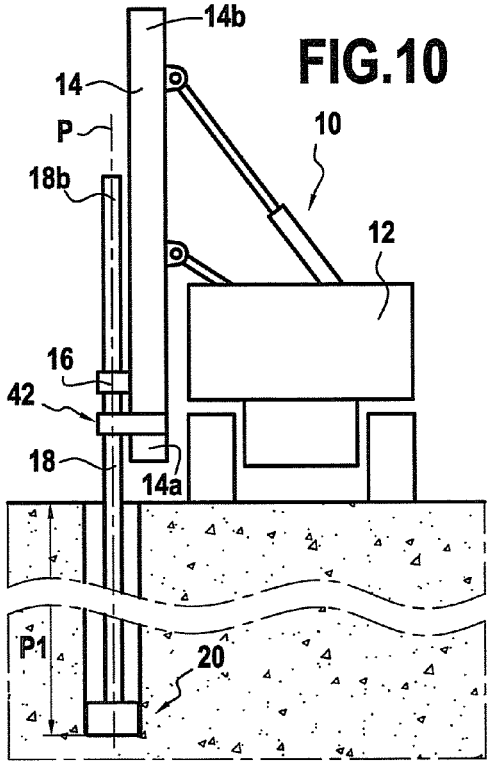

Thereafter, a first step of sinking the excavation tool 20 into the ground is performed, during which step the first holder member 26 is locked so the kelly bar 18 is secured to the carriage 16, with the carriage 16 being moved towards the bottom end 14*a* of the mast 14 (by thrust means not shown), so as to bring the tool into a first sunk position visible in FIG. 10, it being specified that during this step, the second holder member 42 is unlocked.

It will be understood that the depth P1 reached by the excavation tool 20 when in its first sunk position corresponds substantially to the height of the mast 14.

As a result, at the end of the first sinking step, the kelly bar 18 is not fully sunk into the ground insofar as it is longer than the mast 14.

Figure 11:
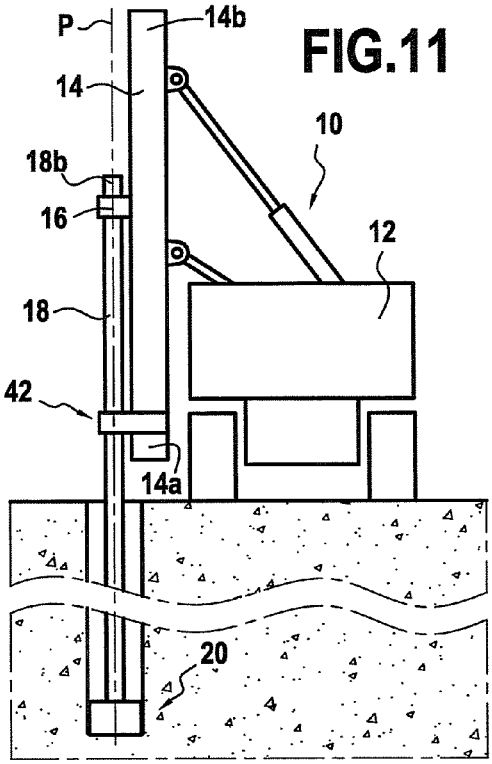

After the first sinking step, the carriage 16 is positioned at the second end 14*b* of the mast 14, or else at a height up the mast corresponding to the second end 18*b* of the kelly bar 18 if the carriage is at a height that is lower than the length of the mast 14, with this taking place after the first holder member 26 has been put into the unlocked state while the excavation tool 20 remains in its first sunk position, as shown in FIG. 11. It will be understood that at this stage, the excavation tool 20 resting on the bottom wall of the trench naturally remains in its first sunk position. Nevertheless, it is also possible to place the second holder member 42 in its locked position so as to hold the kelly bar relative to the mast while the carriage 16 is being moved towards the second end 14*b* of the mast 14.

Thereafter, a second sinking step of the excavation tool is performed, analogous to the first sinking step. In other words, the first holder member 26 is locked to the bar and then the carriage is moved towards the bottom end 14*a* of the mast 14, the second holder member then being unlocked. This second sinking step, shown in FIG. 12, enables the excavation tool 20 to be taken to a second sunk position, at a depth P2.

Figure 12:
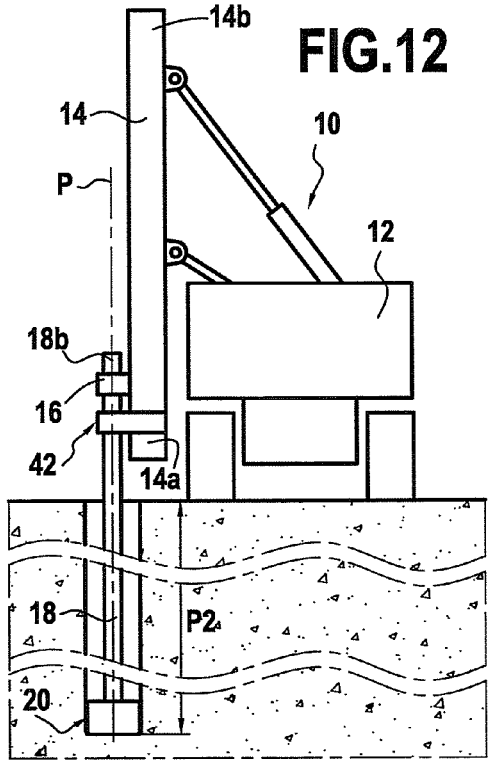

As can be seen in FIG. 12, by means of the invention, the depth P2 to which the excavation tool 20 is sunk, corresponding substantially to the length of the bar 18, is advantageously greater than the stroke of the carriage 16, i.e. the length of the mast 14.

At the end of the second sinking step, a step of raising the excavation tool is performed (not shown) in two stages, performing the sinking steps in reverse.

Returning to FIG. 8, there follows an explanation of how the hydraulic motors 22, 24 of the excavation tool 20 are hydraulically powered.

The excavation machine 10 has a first hydraulic pipe 50 connecting the carriage 16 to the hydraulic motors 22 and 24 via a second end 18*b* of the kelly bar 18 while passing inside the kelly bar 18. For this purpose, the inside of the kelly bar 18 is hollow so that it is possible to place a longitudinal pipe 52 therein connecting the second end 18*b* of the kelly bar 18 to the motors 22, 24.

In practice, the first hydraulic pipe 50 is fastened to one end of a support 54 that is mounted on the carriage 16.

A second hydraulic pipe 56 connects the other end of the support 54 of the carriage 16 to a hydraulic coupling 58 that is located substantially halfway along the mast 14.

This hydraulic coupling 58 is for connection to a source of hydraulic power (not shown), and known in itself.

What is claimed is:

1. An excavation machine comprising:

a mast having a longitudinal direction;

a kelly bar presenting a first end provided with an excavation tool, the excavation tool comprising two rotary tools designed to turn about parallel horizontal axes during excavation operations; and a carriage movable along the longitudinal direction of the mast and including a first holder member for holding the bar relative to the carriage, said carriage being suitable for moving the bar along the longitudinal direction of the mast, wherein the first holder member is pivotable relative to the carriage, and wherein the first holder member presents a locked state in which the bar is prevented from moving in translation relative to the carriage, and an unlocked state in which the bar is free to move in translation relative to the carriage, wherein the mast presents a first end that carries a second holder member suitable for receiving and holding the bar relative to the mast, said second holder member presenting a locked state in translation in which the bar is prevented from moving relative to the mast, and an unlocked state in which the bar is free to move relative to the mast by sliding in the second holder member.

2. The excavation machine according to claim 1, wherein the first holder member is suitable for pivoting about a pivot axis that is orthogonal to the longitudinal direction of the mast.

3. The excavation machine according to claim 2, wherein the pivot axis is orthogonal to an excavation plane.

4. The excavation machine according to claim 1, wherein the bar is suitable for sliding in the first holder member when it is in its unlocked position.

5. The excavation machine according to claim 1, wherein the excavation tool includes at least one hydraulic motor, and wherein the machine further includes at least one first hydraulic pipe connecting the carriage and the hydraulic motor via a second end of the bar opposite from the first end, said first hydraulic pipe passing via the inside of the bar, and at least one second hydraulic pipe connecting the carriage and a hydraulic coupling located substantially halfway along the mast, said coupling being designed to be connected to a hydraulic power source for powering the hydraulic motor.

6. The excavation machine according to claim 1, wherein the excavation tool is a soil-mixing cutter.

7. The method of raising a bar of an excavation machine according to claim 1, said bar presenting a length that is substantially longer than the length of the mast, in which method, starting from a position in which the bar is practically perpendicular to the mast, the bar is brought into a position substantially parallel to the mast by moving the carriage from a first end of the mast towards a second end of the mast opposite from the first end, the bar being prevented from moving relative to the first holder member, wherein said method further includes a step during which the first end of the bar is engaged in the second holder member after the carriage has reached the second end of the mast.

8. The method of raising a bar according to claim 7, in which the first holder member is in the locked state during the movement of the carriage.

9. The excavation machine according to claim 1, wherein the second holder member includes fingers for co-operating with orifices that are formed along the longitudinal edges of the bar so as to enable the bar to be prevented from moving relative to the mast.

10. The excavation machine according to claim 1, wherein the excavation tool is a soil mixing cutter.

11. A method of raising a bar of an excavation machine, the excavation machine comprising: a mast having a longitudinal direction; a bar presenting a first end provided with an excavation tool; and a carriage movable along the longitudinal direction of the mast and including a first holder member for holding the bar relative to the carriage, said carriage being suitable for moving the bar along the longitudinal direction of the mast, wherein the first holder member is pivotable relative to the carriage, and wherein the first holder member presents a locked state in which the bar is prevented from moving in translation relative to the carriage, and an unlocked state in which the bar is free to move in translation relative to the carriage, wherein the mast presents a first end that carries a second holder member suitable for receiving and holding the bar relative to the mast, said second holder member presenting a locked state in which the bar is prevented from moving relative to the mast, and an unlocked state in which the bar is free to move relative to the mast, said bar presenting a length that is substantially longer than the length of the mast, in which the method comprises the step of, when starting from a position in which the bar is substantially perpendicular to the mast, with the excavation tool resting on the ground, the bar is moved moving the bar into a position substantially parallel with the mast by moving the excavation machine towards the excavation tool, the excavation tool remaining stationary, while the first holder member is in the unlocked state.

12. The method of raising a bar according to claim 11, wherein said method further includes a step during which the first end of the bar is engaged in the second holder member after the carriage has reached the second end of the mast.

13. An excavation method in which the excavation machine according to claim 1 is provided, said machine including a bar that is substantially longer than the mast, said method comprising the following successive steps:

a raising step during which the bar is brought into a position substantially parallel with the mast;

a positioning step in which the carriage is positioned at the second end of the mast;

a first sinking step of sinking the excavation tool into the ground, during which the first holder member is locked if it is not already locked, and the carriage while locked to the bar is moved towards the first end of the mast so as to bring the excavation tool into a first sunk position;

a positioning step in which the carriage is positioned at the second end of the mast, or else at a height along the mast corresponding to the second end of the bar if the second end is at a height less than the length of the mast, after the first holder member has been put into the unlocked state, the excavation tool remaining in its first sunk position; and a second sinking step of sinking the excavation tool, this step being analogous to the first sinking step, so as to bring the excavation tool into a second sunk position, wherein the first end of the bar is engaged in the second holder member at the end of the raising step, wherein during the first sinking step, the second holder member is in the unlocked state, and wherein, at the end of the first sinking step, a locking step is performed of locking the second holder member so as to prevent the bar from moving relative to the mast.

14. An excavation machine comprising:

a mast having a longitudinal direction;

a kelly bar presenting a first end provided with an excavation tool, the excavation tool comprising two rotary tools designed to turn about parallel horizontal axes during excavation operations; and a carriage movable along the longitudinal direction of the mast and including a first holder member for holding the bar relative to the carriage, said carriage being suitable for moving the bar along the longitudinal direction of the mast, wherein the first holder member is pivotable relative to the carriage, and wherein the first holder member presents a locked state in which the bar is prevented from moving in translation relative to the carriage, and an unlocked state in which the bar is free to move in translation relative to the carriage, wherein the mast presents a first end that carries a second holder member suitable for receiving and holding the bar relative to the mast, said second holder member presenting a locked state in translation in which the bar is prevented from moving relative to the mast, and an unlocked state in which the bar is free to move relative to the mast by sliding in the second holder member, wherein the first holder member is suitable for pivoting about a pivot axis that is orthogonal to the longitudinal direction of the mast, and wherein said bar presenting a length that is substantially longer than the length of the mast.

15. An excavation machine comprising:

a mast having a longitudinal direction;

a kelly bar presenting a first end provided with an excavation tool, the excavation tool comprising two rotary tools designed to turn about parallel horizontal axes during excavation operations; and a carriage movable along the longitudinal direction of the mast and including a first holder member for holding the bar relative to the carriage, said carriage being suitable for moving the bar along the longitudinal direction of the mast, wherein the first holder member is pivotable relative to the carriage, and wherein the first holder member presents a locked state in which the bar is prevented from moving in translation relative to the carriage, and an unlocked state in which the bar is free to move in translation relative to the carriage, wherein the mast presents a first end that carries a second holder member suitable for receiving and holding the bar relative to the mast, said second holder member presenting a locked state in translation in which the bar is prevented from moving relative to the mast, and an unlocked state in which the bar is free to move relative to the mast by sliding in the second holder member, wherein the first holder member is suitable for pivoting about a pivot axis that is orthogonal to the longitudinal direction of the mast, and wherein the pivot axis is orthogonal to an excavation plane.

* * * * *